US012188345B2

(12) United States Patent
Kuhlman

(10) Patent No.: US 12,188,345 B2
(45) **Date of Patent: *Jan. 7, 2025**

(54) WELLBORE TOOL INCLUDING A PETRO-PHYSICAL IDENTIFICATION DEVICE AND METHOD FOR USE THEREOF

(71) Applicant: Halliburton Energy Services, Inc., Houston, TX (US)

(72) Inventor: Michael Werner Kuhlman, Kingwood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/348,180

(22) Filed: Jun. 15, 2021

(65) Prior Publication Data

US 2021/0310351 A1 Oct. 7, 2021

Related U.S. Application Data

(63) Continuation of application No. 16/403,064, filed on May 3, 2019, now Pat. No. 11,047,229.
(Continued)

(51) Int. Cl.
*E21B 49/00* (2006.01)
*E21B 10/00* (2006.01)
(Continued)

(52) U.S. Cl.
CPC ..... *E21B 47/017* (2020.05); *E21B 10/00* (2013.01); *E21B 43/10* (2013.01); *E21B 49/00* (2013.01); *E21B 17/10* (2013.01); *E21B 47/18* (2013.01)

(58) Field of Classification Search
CPC ..... E21B 7/20; E21B 17/10; E21B 17/1007; E21B 17/1078; E21B 43/10; E21B 47/18; E21B 49/00
See application file for complete search history.

(56) References Cited

U.S. PATENT DOCUMENTS 4,825,947 A * 5/1989 Mikolajczyk ..... E21B 47/053 166/241.1
6,540,032 B1 * 4/2003 Krueger ..... E21B 41/0085 175/320

(Continued)

FOREIGN PATENT DOCUMENTS

| | | |
|---|---|---|
| CA | 2974494 | 9/2016 |
| WO | 2009029816 A2 | 3/2009 |
| WO | 2017146675 A1 | 8/2017 |

OTHER PUBLICATIONS

"Integral Definition and Meaning", Merriam-Webster.com Dictionary, Merriam-Webster, p. 1 (Year: 2023).*

*Primary Examiner* — Tara Schimpf
*Assistant Examiner* — Lamia Quaim
(74) *Attorney, Agent, or Firm* — Scott Richardson; Parker Justiss, P.C.

(57) ABSTRACT

Provided, in one example, is a wellbore tool. The wellbore tool, in this example, includes a casing having three or more pads located on an outer diameter thereof, at least one of the pads having a pocket therein. The wellbore tool of this example additionally includes one or more batteries and one or more sensors located within the pocket, and one or more additional components coupled to the one or more sensors located within an inner diameter of the casing.

15 Claims, 8 Drawing Sheets

Related U.S. Application Data

(60) Provisional application No. 62/720,235, filed on Aug. 21, 2018, provisional application No. 62/686,375, filed on Jun. 18, 2018.

(51) Int. Cl.

| | |
|---|---|
| ***E21B 43/10*** | (2006.01) |
| ***E21B 47/017*** | (2012.01) |
| *E21B 17/10* | (2006.01) |
| *E21B 47/18* | (2012.01) |

(56) References Cited

U.S. PATENT DOCUMENTS

| | | | | |
|---|---|---|---|---|
| 7,334,650 | B2 | 2/2008 | Giroux et al. | |
| 9,243,492 | B2 | 1/2016 | Fraser | |
| 9,771,793 | B2 | 9/2017 | Fraser et al. | |
| 9,828,853 | B2 | 11/2017 | Chambers | |
| 9,896,926 | B2 | 2/2018 | Steele | |
| 2005/0006090 | A1 | 1/2005 | Chemali et al. | |
| 2006/0196695 | A1 | 9/2006 | Giroux et al. | |
| 2006/0254767 | A1* | 11/2006 | Pabon | G01V 1/52 166/254.2 |
| 2007/0267221 | A1 | 11/2007 | Giroux et al. | |
| 2009/0179648 | A1 | 7/2009 | Fredette et al. | |
| 2011/0057656 | A1* | 3/2011 | Tchakarov | E21B 10/00 324/369 |
| 2011/0192592 | A1 | 8/2011 | Roddy et al. | |
| 2011/0277984 | A1 | 11/2011 | Woie et al. | |
| 2012/0106297 | A1 | 5/2012 | Fraser | |
| 2012/0168228 | A1 | 7/2012 | Giroux et al. | |
| 2013/0008647 | A1 | 1/2013 | Dirksen et al. | |
| 2013/0087341 | A1 | 4/2013 | Reid et al. | |
| 2013/0087344 | A1 | 4/2013 | Reid et al. | |
| 2013/0206401 | A1 | 8/2013 | Bhoite et al. | |
| 2013/0233547 | A1 | 9/2013 | Twardowski et al. | |
| 2013/0292110 | A1 | 11/2013 | Fraser et al. | |
| 2014/0041881 | A1 | 2/2014 | Dirksen et al. | |
| 2014/0124215 | A1 | 5/2014 | Duphorne | |
| 2015/0184506 | A1 | 7/2015 | Brown-Kerr et al. | |
| 2015/0240630 | A1 | 8/2015 | Chambers | |
| 2016/0047237 | A1 | 2/2016 | Brown-Kerr et al. | |
| 2016/0208605 | A1* | 7/2016 | Morrow | E21B 47/14 |
| 2016/0230533 | A1 | 8/2016 | Steele | |
| 2016/0265350 | A1 | 9/2016 | Brown-Kerr et al. | |
| 2016/0356153 | A1 | 12/2016 | Carter | |
| 2017/0114632 | A1* | 4/2017 | Orban | E21B 47/01 |
| 2017/0247959 | A1 | 8/2017 | Dirksen et al. | |
| 2018/0230779 | A1* | 8/2018 | Bridges | E21B 41/0085 |

* cited by examiner

WELLBORE TOOL INCLUDING A PETRO-PHYSICAL IDENTIFICATION DEVICE AND METHOD FOR USE THEREOF

CROSS-REFERENCE TO RELATED APPLICATION

This application is a continuation of U.S. application Ser. No. 16/403,064 filed on May 3, 2019, entitled "WELLBORE TOOL INCLUDING A PETRO-PHYSICAL IDENTIFICATION DEVICE AND METHOD FOR USE THEREOF", which application claims the benefit of International Application Serial No. PCT/US2018/065517 filed on Dec. 13, 2018, entitled "A WELLBORE TOOL INCLUDING A PETRO-PHYSICAL IDENTIFICATION DEVICE AND METHOD FOR USE THEREOF," which claims the benefit of U.S. Provisional Application Ser. No. 62/686,375, filed on Jun. 18, 2018, entitled "DRILLABLE PETRO-PHYSICAL IDENTIFICATION DEVICE AND METHOD FOR USE THEREOF," and U.S. Provisional Application Ser. No. 62/720,235, filed on Aug. 21, 2018, entitled "DRILL SHOE HAVING A DRILLABLE PETRO-PHYSICAL IDENTIFICATION DEVICE AND METHOD FOR USE THEREOF," all of which are commonly assigned with this application and incorporated herein by reference.

BACKGROUND

Certain oil/gas drilling applications desire to set the drill casing as close as possible above a depleted zone. Today's drilling processes utilize drilling tools such as directional, pressure while drilling (PWD), resistivity, gamma ray, and a rotary steerable system to place the drill casing as close as possible to the depleted zone or significant geologic pressure transition zone. A significant geologic transition pressure zone can be defined as a formation that requires a major increase or decrease in mud weight. Failure to stop and set casing above this point, and thus breaching the significant geologic pressure transition zone, can lead to well control issue and place the well at risk. Conventional liner drilling may then be used to drill in the last distance (e.g., 100 meters or less of formation) to the prescribed point above the depleted zone or significant geologic pressure transition zone.

Geologic stop points are currently defined by cutting sample identification at the surface. Unfortunately, such processes for determining the geologic stop points have limited success. Accordingly, significant financial losses (e.g., due to loss of well construction by missing this marker) are common.

What is needed in the art is a wellbore tool and process that will allow the user to have a real-time and accurate confirmation of the geologic "Geostop" marker.

BRIEF DESCRIPTION

Reference is now made to the following descriptions taken in conjunction with the accompanying drawings, in which.

DETAILED DESCRIPTION

Figure 1:
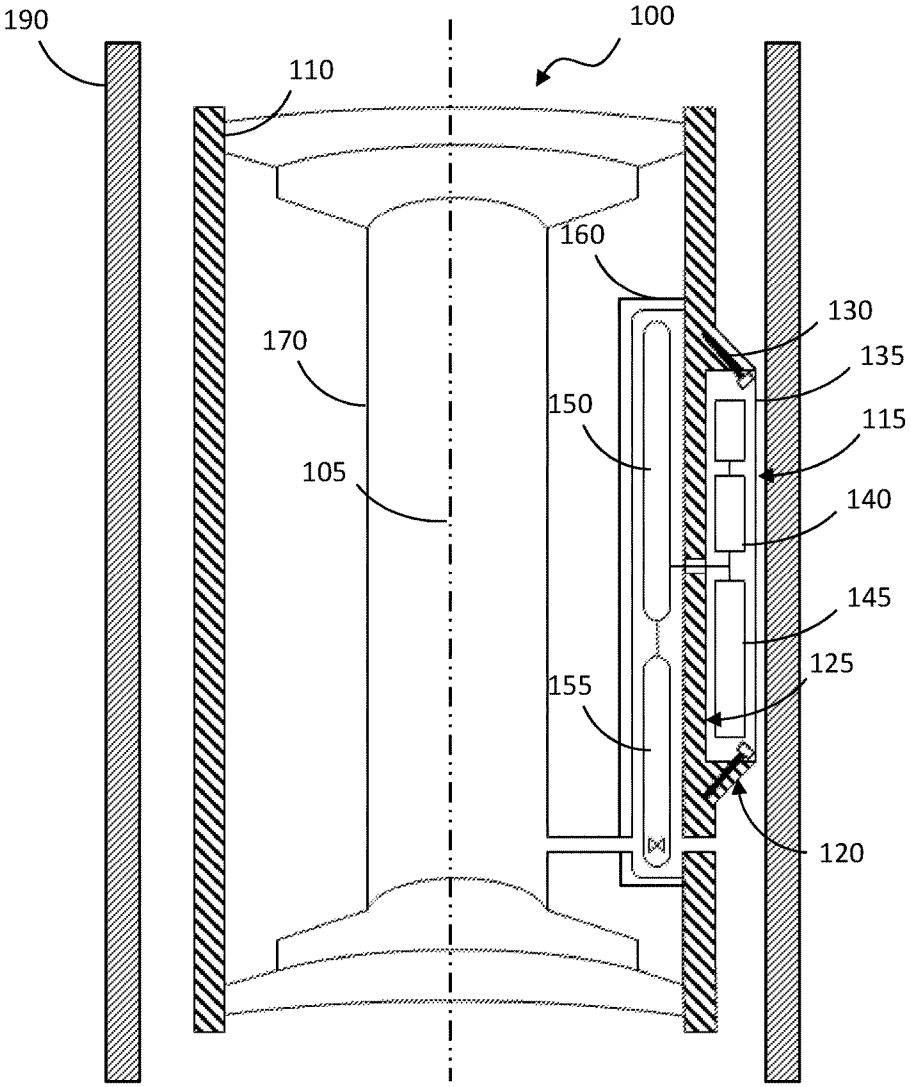
FIGS. 1 and 2 illustrate various views of a wellbore tool including a petro-physical property identification device manufactured in accordance with the disclosure.

In the drawings and descriptions that follow, like parts are typically marked throughout the specification and drawings with the same reference numerals, respectively. The drawn figures are not necessarily to scale. Certain features of the disclosure may be shown exaggerated in scale or in somewhat schematic form and some details of certain elements may not be shown in the interest of clarity and conciseness. The present disclosure may be implemented in embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "uphole," "upstream," or other like terms shall be construed as generally toward the surface of the formation; likewise, use of the terms "down," "lower," "downward," "downhole," or other like terms shall be construed as generally toward the bottom, terminal end of a well, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Turning to FIG. 1 illustrated is a cross-sectional view of a wellbore tool 100 including a downhole petro-physical property identification device 115 manufactured according to one embodiment of the disclosure. In the embodiment shown, the wellbore tool 100 is placed within a wellbore 190. The wellbore tool 100, in one embodiment, may form part of a liner drilling apparatus or drill shoe, among others. In the illustrated embodiment, the wellbore tool 100 is positioned between the drill shoe and the top of the float joint, and thus form a part of the float collar assembly. According to this embodiment, the wellbore tool 100 would be positioned above the drill bit of the liner drilling apparatus. In another embodiment, the wellbore tool 100 could be positioned below the top of the float joint, and thus form the bottom most portion of a liner drilling apparatus. For example, as discussed further below, the wellbore tool 100 could form at least a portion of a drill shoe.

The wellbore tool 100, in the embodiment of FIG. 1, includes a casing 110. The casing 110 might be a casing pup joint in one embodiment, but the casing 110 could be another structure and remain within the scope of the disclosure.

Located on the outer diameter (OD) of the casing 110, as part of the petro-physical property identification device 115 in the embodiment of FIG. 1, is a pad 120. The term pad, as used herein, refers to a physical protrusion away from the casing 110 that interrupts the natural curvature of the casing 110. Only a single pad 120 is illustrated in the view of FIG. 1, but as will be further understood below, the casing 110 may have more than one pad 120 and remain within the purview of the disclosure. In fact, the casing 110 will often have three or more pads 120.

In certain embodiments, the casing 110 will have from three to six substantially equally spaced pads 120. The term substantially equally spaced, as used in this context, means that the pads 120 are equally spaced around the casing 110 within a tolerance of about ±10 degrees. As the pads 120 are substantially equally spaced, the casing 110 easily rotates upon a centerline 105 without wobbling when rotated during deployment. Thus, if the casing 110 had three pads 120, the three pads 120 would be radially separated by about 120 degrees (±10 degrees), if the casing 110 had four pads 120, the four pads 120 would be radially separated by about 90 degrees (±10 degrees), if the casing 110 had five pads 120, the five pads 120 would be radially separated by about 72 degrees (±10 degrees), and if the casing 110 had six pads 120, the six pads 120 would be radially separated by about 60 degrees (±10 degrees). It should be noted that if there are too many pads 120, there will not be space there between for cuttings and such to exit the wellbore 190. While the pads 120 are illustrated in FIG. 1 as being substantially parallel with the centerline 104, the pads 120 may also be constructed to have a pitch angle by offsetting the top of the pad from the bottom of the pad to create a spiral. This pitch angle can effectively create a clockwise spiral or an anti-clockwise spiral depending on the offset angle between the top and bottom of the pads 120.

One or more of the pads 120 may include a pocket 125. In the embodiment of FIG. 1, the pocket 125 is on the OD of the casing 110, and thus is accessible from the outside of the wellbore tool 100. For instance, in the embodiment of FIG. 1, one or more fasteners 130 may couple a protective surface 135 to the casing 110 to protect any components contained within the pocket 125. In other embodiments, the pocket 125 is accessible from the inside of the wellbore tool 100.

Located within the pocket 125 in the embodiment of FIG. 1, are various different oil/gas components and/or sensors. For instance, in the embodiment of FIG. 1, the wellbore tool 100 includes a battery 140 and a sensor 145. The battery 140 may be any battery that is currently, or may be in the future, used downhole in an oil/gas well. For example, the battery 140 could be a lithium ion battery, or any other battery, and remain with the scope of the present disclosure.

The sensor 145 may be any sensor that is currently, or may be in the future, used downhole in an oil/gas well. For example, the sensor 145 may be any sensor configured to identify a petro-physical property of the surrounding formation, among other sensors. For example, the sensor 145 could be a lithology property sensor in one embodiment. Accordingly, the lithology property sensor might be a gamma ray sensor for finding a geologic stop point during drilling. An alternative embodiment would be to have the sensor sense gravity to discern the tools physical orientation with respect to gravity in the wellbore.

In the embodiment of FIG. 1, coupled to the battery 140 and/or sensor 145 on an inner diameter (ID) of the casing 110 are one or more additional components 150, 155. The additional components 150, 155, in accordance with the disclosure, could be PCB electronic components and mud pulse telemetry components, respectively, among many other components that might be used in an oil/gas drilling operation. Those skilled in the art understand the various different electronic and mud pulse telemetry components that might be used and remain within the scope of the present disclosure. In the instance wherein the component 150 is a PCB electronic component, and the component 155 is a mud pulse telemetry component, readings from the sensor 145 could be sent uphole using the same. Thus, if the sensor 145 were a gamma ray sensor configured to detect geologic stop points, the readings from the gamma ray sensor could be sent uphole using the PCB electronic component and mud pulse telemetry component. If the sensor were to detect its orientation with respect to gravity, the readings can be sent uphole using the PCB electronic component and the mud pulse telemetry component.

Surrounding the one or more additional components 150, 155, in the embodiment of FIG. 1, is a protective cover 160. The protective cover 160, which may be an aluminum packet, among others, substantially surrounds the additional components 150, 155 in the embodiment of FIG. 1.

The wellbore tool 100 according to the disclosure may additionally include a conduit 170 on an interior thereof. The conduit 170, in one embodiment, is centered on the wellbore tool 100, and is of sufficient size to not obstruct drilling, circulating or cementing operations, among other operations. Those skilled in the art understand the process for determining the appropriate size of the conduit 170.

In accordance with one embodiment, the components of the wellbore tool 100 within the ID of the casing 110 will be removed from the wellbore 190 at some point after the wellbore tool 100 has served its purpose, whereas the components of the wellbore tool 100 on the OD of the casing 110 may remain within the wellbore 190 for the foreseeable future. For instance, those components located within the ID of the casing 110 and those components located on the OD of the casing 110 may be specifically chosen with this in mind. Accordingly, those components that are not dangerous or otherwise undesirable to roam within the wellbore 190 may be located within the ID of the casing 110, but those components that are dangerous or otherwise should not roam within the wellbore 190 may be located on the OD of the casing 110. Thus, in the embodiment of FIG. 1, the one or more batteries 140 and sensor 145 are located on the OD of the casing 110, and thus will remain within the wellbore 190 after the other components of the wellbore tool 100 are removed.

The wellbore tool 100, in one embodiment, is manufactured to assist in the easy removal thereof. For instance, certain of the components can be manufactured of easily drillable materials. For instance, certain of the components could be manufactured of ceramic or another easily drillable material. Additionally, the wellbore tool 100, or at least those portions of the wellbore tool 100 within the ID of the casing 110, may be formed of a collection of smaller parts. Accordingly, the collection of smaller parts may be more easily removed than if the portions of the wellbore tool 100 within the ID of the casing 110 were formed of a single solid part. In one embodiment, the ID of the casing 110 may be accessed with conventional rotary drilling tools after reaching the Geo Stop marker. Accordingly, those features within the ID may be drilled out.

Figure 2:
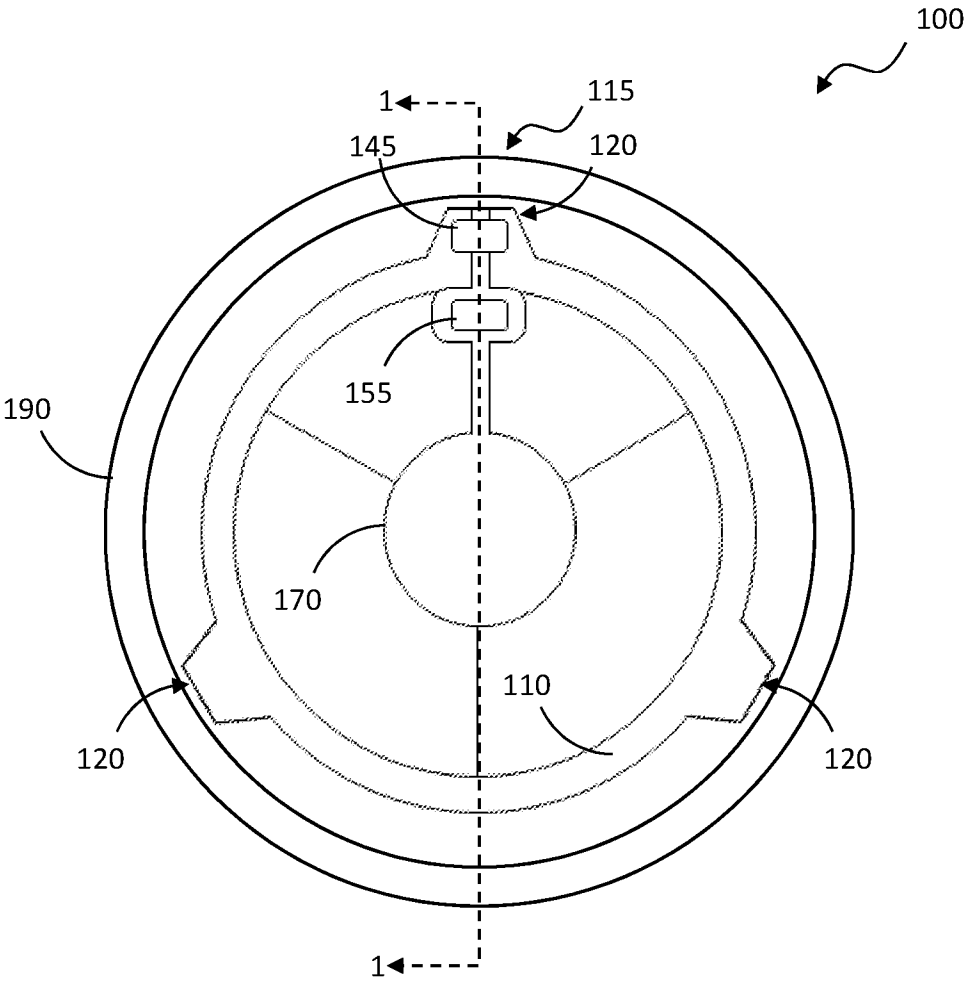

Turning to FIG. 2, illustrated is a different view of a wellbore tool 100 manufactured according to the disclosure. For clarity, like reference numerals are used to reference similar (e.g., substantially similar or the like) features. As is illustrated in FIG. 2, the wellbore tool 100 includes three pads 120, each separated by about 120 degrees. Similarly, the battery 140 and sensor 145 are only illustrated as located within a single pad 120, but those skilled in the art understand that more than one of the pads 120 can be used to house additional components. The conduit 170, as illustrated in FIG. 2, is a multi part design. Being a multi part (e.g., three part in the illustrated embodiment) design, the conduit 170 may be more easily removed. Those skilled in the art understand that while three parts are shown, other numbers of parts are within the scope of the present disclosure.

Figure 3:
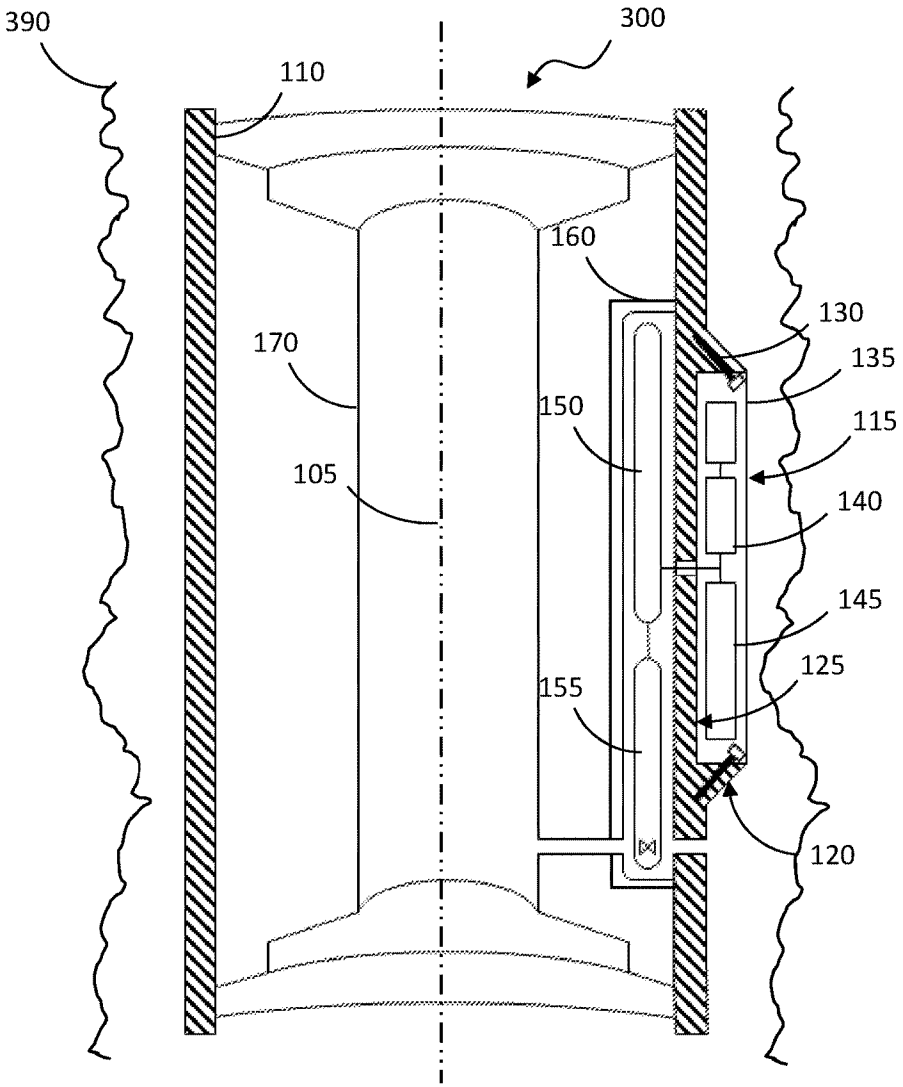
FIG. 3 illustrates an alternative embodiment of a wellbore tool including a petro-physical property identification device manufactured in accordance with the disclosure.

Turning to FIG. 3, illustrated is another embodiment of a wellbore tool 300 manufactured according to the disclosure. The wellbore tool 300 of FIG. 3 is very similar to the wellbore tool 100 of FIG. 1. Accordingly, like reference numerals are used to reference like features. The wellbore tool 300 of FIG. 3, however, is positioned within an open hole formation 390, which could exist if the wellbore tool 300 were being used with an open hole liner drilling operation.

A wellbore tool according to this disclosure will allow the user to have real-time confirmation of the geologic "Geostop" marker, drill the prescribed distance and either set the liner un-cemented or cement the liner in place. The wellbore tool may then be drilled out with the next assembly, providing full bore access with no ID restriction for future operations below the casing shoe. A drillable real time wellbore tool does not exist in the market. This task, traditionally, was done with either casing drilling with existing MWD equipment, or done with sacrificial MWD equipment that would be part of an inner string. In either case, cementing through or drilling out with this traditional equipment is not practical or economically feasible. A design according to this disclosure will be a gateway for future in zone MLT operations in this field, as it preserves full ID at drill out. It can be an enabling technology for advanced completion installations where a confirmed geologic setting point for casing is required.

Any sensors that require electricity and fit in the outer pockets would be suitable for this packaging as the batteries may remain parked in the cemented annulus. Additional sensors may be added to the other blades to have multiple measurements by the reconfiguration of the insert assembly. This wellbore tool, after it has performed its function, will facilitate a full drift drillable ID.

Figure 4:
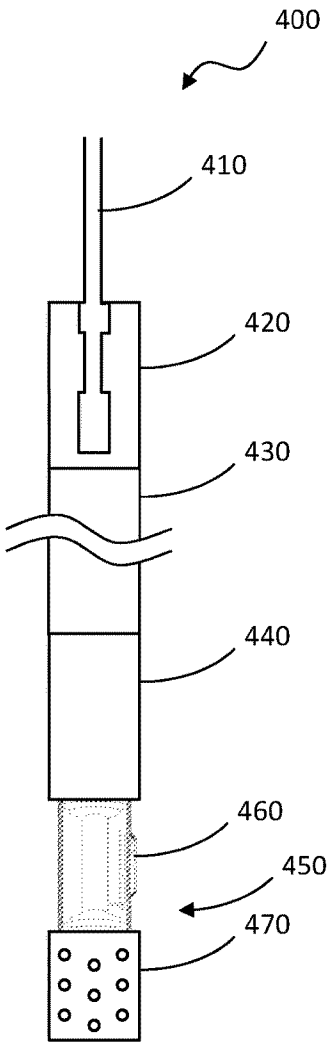
FIG. 4 illustrates a liner drilling apparatus according to the disclosure.

Turning briefly to FIG. 4, illustrated is a liner drilling apparatus 400 according to the disclosure. The liner drilling apparatus 400, in this embodiment and at a high level, includes drill pipe 410. While not shown in the illustrated view, the drill pipe 410 would extend uphole to the surface of an oil/gas well. The liner drilling apparatus 400 of the embodiment of FIG. 4 additionally includes a liner hanger 420 (e.g., a versaflex liner hanger in one embodiment) positioned downhole of the drill pipe 410. The liner drilling apparatus 400, in this embodiment and at a high level, additionally includes a liner 430. As illustrated, the liner 430 may extend over a chosen distance. Downhole of the liner 430, in the embodiment of FIG. 4, is a float collar 440. Further to this embodiment, coupled to and downhole of the float collar 440 is a wellbore tool 450 including a petro-physical property identification device 460 manufactured according to the present disclosure. The wellbore tool 450, in one embodiment, may be similar to the wellbore tools illustrated in FIGS. 1-3 above. Positioned downhole of the wellbore tool 450, in the embodiment shown, is a drill shoe 470.

Figure 5:
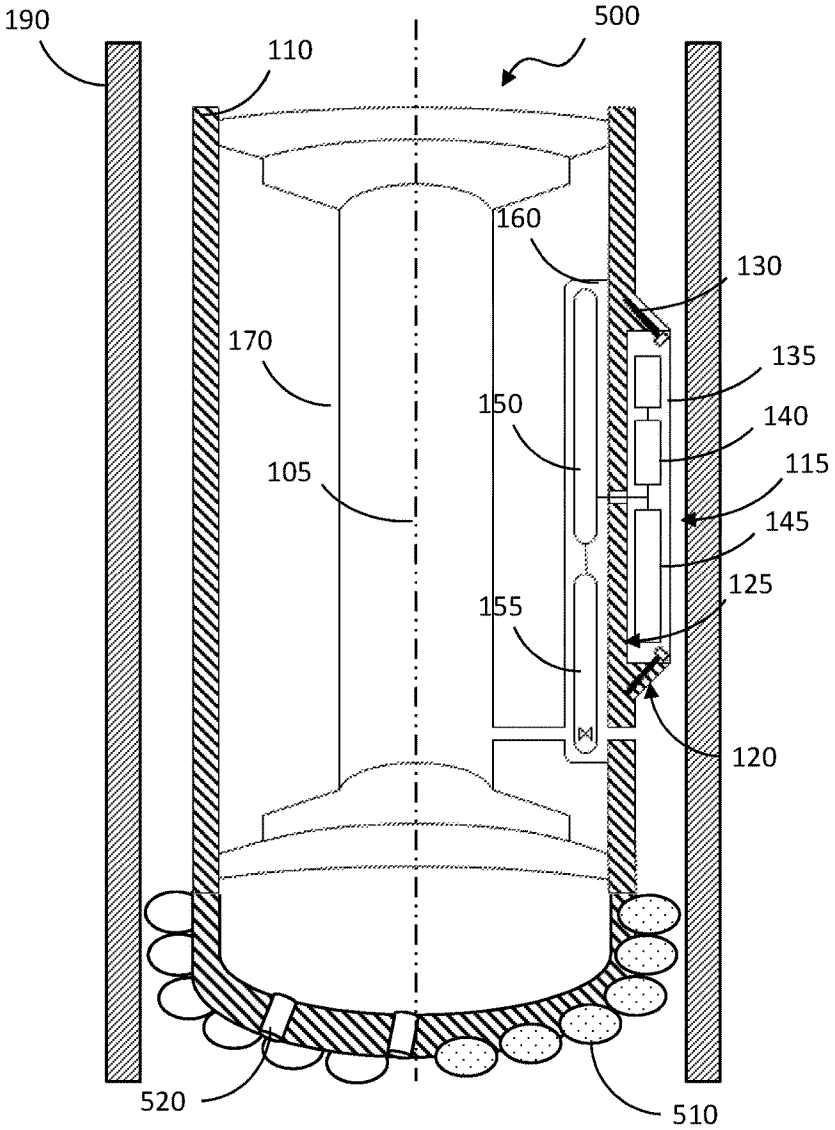
FIGS. 5 and 6 illustrate various views of an alternative embodiment of a wellbore tool including a petro-physical property identification device manufactured in accordance with the disclosure.
Figure 6:
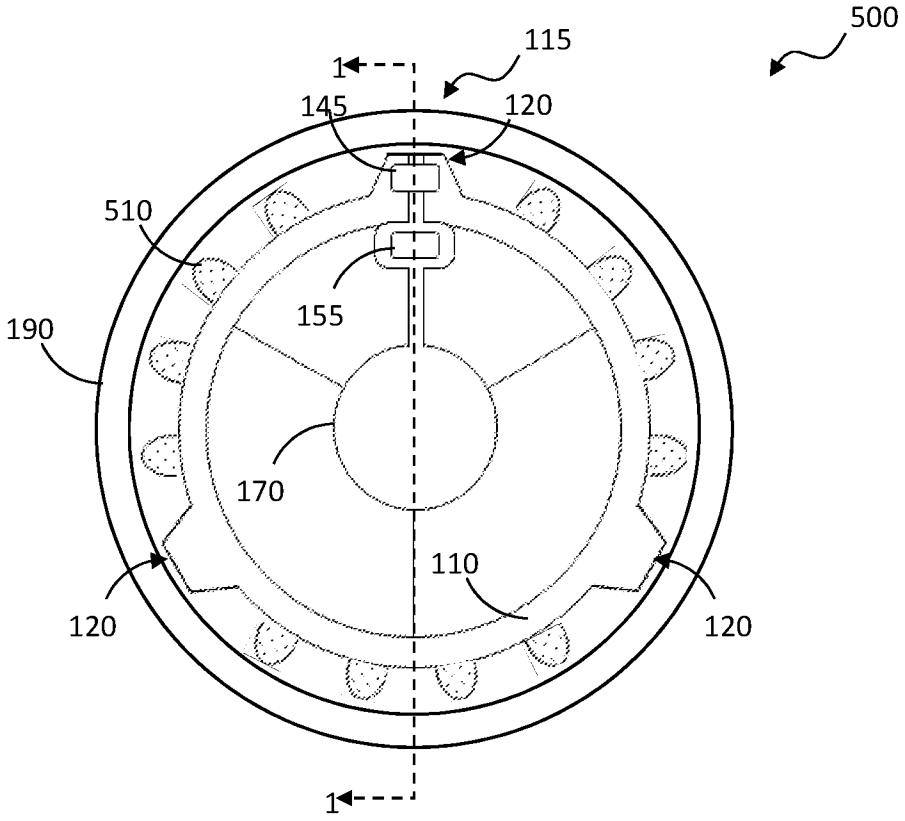

Turning now to FIGS. 5 and 6, illustrated are different views of a wellbore tool 500 according to a different embodiment of the disclosure. The wellbore tool 500 of FIGS. 5 and 6 is similar in many respects to the wellbore tool 100 of FIGS. 1 and 2. Accordingly, like reference numbers have been used to reference like (e.g., similar, substantially similar, identical, or the like) features. In the embodiment of FIGS. 5 and 6, however, the wellbore tool 500 forms at least a portion of a drill shoe. Accordingly, in this embodiment the wellbore tool 500 would further include a plurality of cutting elements 510 positioned proximate a downhole portion thereof. As those skilled in the art appreciate, the cutting elements 510 are configured to dislodge or otherwise remove cutting from an interior of the wellbore. The number and position of the cutting elements 510 may vary greatly while remaining within the purview of the present disclosure.

The wellbore tool 500 according to the embodiment of FIGS. 5 and 6 further includes one or more flow tubes 520 connecting an interior of the wellbore tool 500 and an exterior of the wellbore tool 500. The flow tubes 520, in accordance with this embodiment, provide a flow path for drilling mud and/or other drilling fluids to travel from the surface of the wellbore, through the conduit 170, out the flow tubes 520 and into the bottom of wellbore, wherein the mud and/or other drilling fluid may be used to assist in the drilling of the wellbore. The number and location of the flow tubes 520 may vary greatly while remaining within the purview of the present disclosure.

In one embodiment, the petro-physical identification device 115 would be formed as close to, or as a part of, the portion of the wellbore tool 500 including the cutting elements 510. For example, the petro-physical identification device 115 might be formed within about 0.75 meters, or in another embodiment within about 0.5 meters, of the portion of the wellbore tool 500 including the cutting elements 510. Thus, while the petro-physical identification device 115 is illustrated a good distance uphole of the cutting elements 510, it should be recognized that the two could be closer to one another and remain within the purview of the disclosure. Similarly, the petro-physical identification device 115 could be located a greater distance uphole of the cutting elements 510 than is shown in FIG. 1.

In accordance with one embodiment, the casing 110 forms a single unitized piece that includes the feature of the petro-physical property identification device 115, as well as the cutting elements 510 and flow tubes 520. For example, in one embodiment, the wellbore tool 500 is not two separate pieces (e.g., the petro-physical property identification device 115, and drill shoe tip including the cutting elements 510 and flow tubes 520), but is a single unitized part that includes such features. According to this embodiment, the wellbore tool 500 would be manufactured and sold as a single unitized part.

Figure 7:
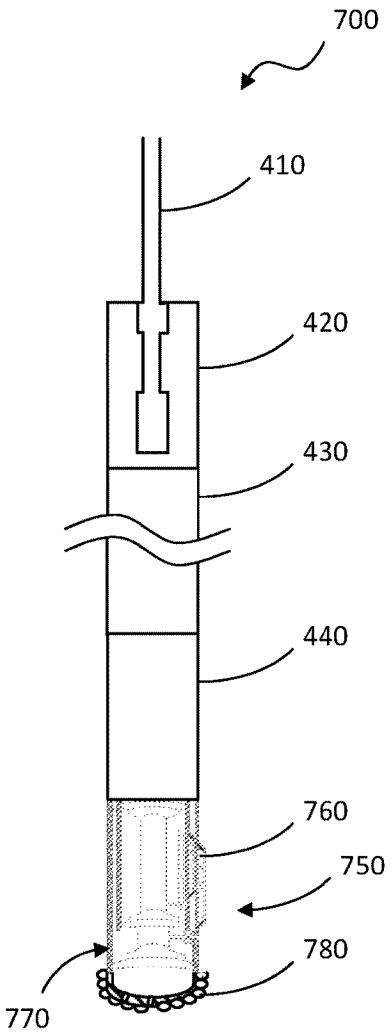
FIG. 7 illustrates an alternative embodiment of a liner drilling apparatus according to the disclosure.

Turning briefly to FIG. 7, illustrated is a liner drilling apparatus 700 according to an alternative embodiment of the disclosure. The liner drilling apparatus 700 of FIG. 7 is similar in many respects to the liner drilling apparatus 400 of FIG. 4. Accordingly, like reference numbers have been used to reference like (e.g., similar, substantially similar, identical, or the like) features. The liner drilling apparatus 700, in this embodiment and at a high level, includes the drill pipe 410. The liner drilling apparatus 700, in this embodiment and at a high level, additionally includes the liner 430 and the float collar 440. Further to this embodiment, coupled to and downhole of the float collar 440 is a wellbore tool 750 manufactured according to the present disclosure. The wellbore tool 750, in accordance with one embodiment, includes the petro-physical property identification device 760, and forms at least a portion of a drill shoe 770, and thus includes cutting elements 780. The wellbore tool 750, in one embodiment, may be similar to the wellbore tool 500 illustrated in FIGS. 5 and 6 above.

Figure 8:
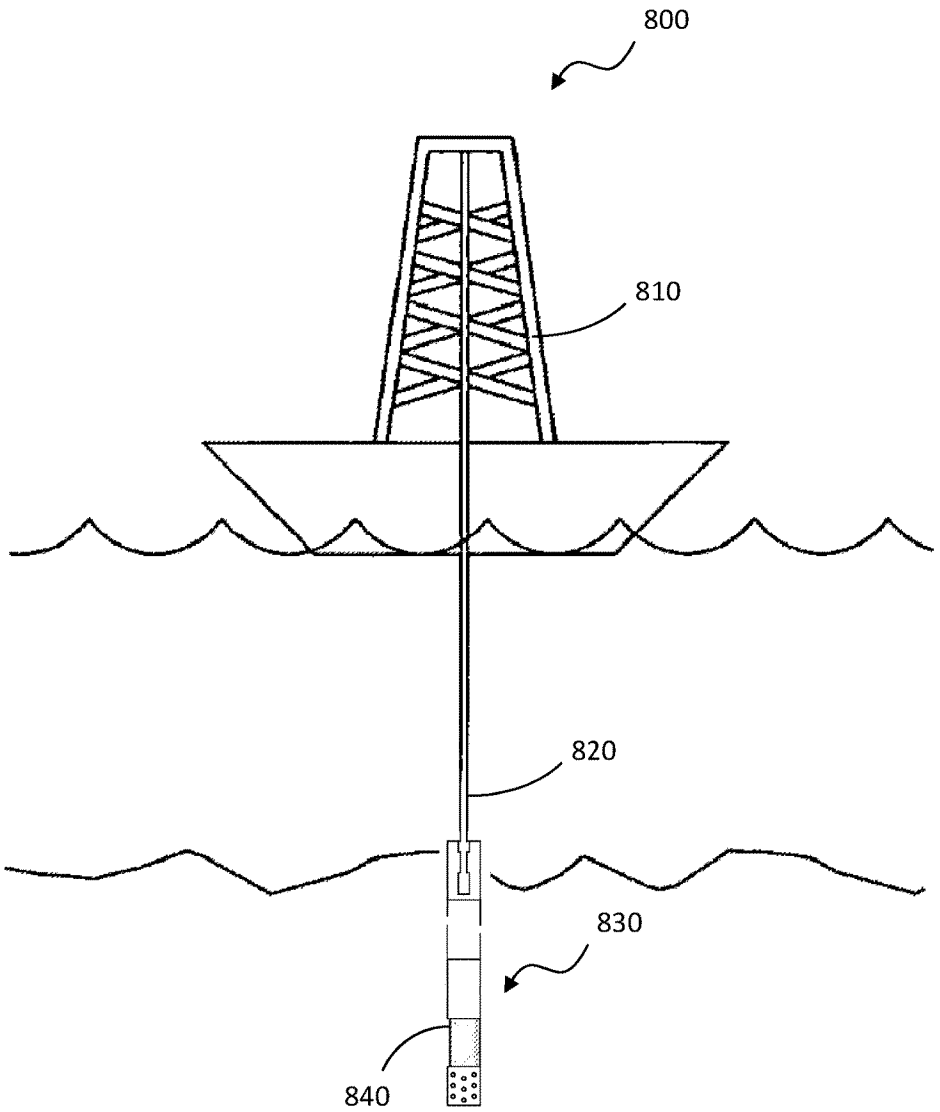
FIG. 8 illustrates an oil/gas drilling system.

Turning briefly to FIG. 8, illustrated is an oil/gas drilling system 800. The oil/gas drilling system 800 includes a drill platform 810. The oil/gas drilling system 800 additionally includes a liner drilling apparatus 830 connected by drill pipe 820 to the drill platform 810. In accordance with the disclosure, the liner drilling apparatus 830 may include a wellbore tool 840 including a petro-physical property identification device according to the disclosure. The wellbore tool 840, in one embodiment, is positioned uphole of a drill shoe, and in another embodiment, forms a portion of a drill shoe.

Aspects disclosed herein include:

A. A wellbore tool including: a casing having three or more pads located on an outer diameter thereof, at least one of the pads having a pocket therein, one or more batteries and one or more sensors located within the pocket, and one or more additional components coupled to the one or more sensors located within an inner diameter of the casing.

B. An oil/gas drilling system including: a wellbore located within a subterranean formation, a liner drilling apparatus located with the subterranean formation, the liner drilling apparatus including a drillpipe, a liner hanger positioned downhole of the drillpipe, a wellbore tool coupled downhole of the liner hanger. The wellbore tool, in this example, includes: a casing having three or more pads located on an outer diameter thereof, at least one of the pads having a pocket therein, one or more batteries and one or more sensors located within the pocket, and one or more additional components coupled to the one or more sensors located within an inner diameter of the casing.

C. A method for drilling a wellbore, including: placing a liner drilling apparatus in a wellbore located within a subterranean formation, the liner drilling apparatus including, a drillpipe, a liner hanger positioned downhole of the drillpipe, and a wellbore tool coupled downhole of the liner hanger. The wellbore tool, in this example, includes: a casing having three or more pads located on an outer diameter thereof, at least one of the pads having a pocket therein, one or more batteries and one or more sensors located within the pocket, and one or more additional components coupled to the one or more sensors located within an inner diameter of the casing. The method further includes drilling out the one or more additional components from the casing while leaving the one or more batteries and one or more sensors located within the pocket after finish using the drilling apparatus.

Aspects A, B, and C may have one or more of the following additional elements in combination:

Element 1: wherein the three or more pads are substantially equally spaced. Element 2: wherein an inner diameter (ID) of the casing may be accessed with conventional rotary drilling tools after reaching a Geo Stop marker. Element 3: wherein the pocket is accessible from an exterior surface of the wellbore tool via a removable protective surface. Element 4: further including a plurality of cutting elements located proximate a lower surface of the casing, the plurality of cutting elements forming at least a portion of a drill shoe. Element 5: wherein the three or more pads, one or more batteries, and one or more additional components form at least a portion of a petro-physical property identification device, and further wherein the petro-physical property identification device and the drill shoe including the plurality of cutting elements form a single unitized piece. Element 6: wherein the one or more additional components are one or more electronic components. Element 7: wherein the one or more additional components are one or more mud pulse telemetry components. Element 8: wherein a multi-piece conduit is located within the inner diameter of the casing. Element 9: further including a float collar positioned between the liner and the wellbore tool. Element 10: wherein the wellbore tool additionally includes a multi-piece conduit located within the inner diameter of the casing, and further wherein drilling out the one or more additional components includes drilling out the multi-piece conduit.

Those skilled in the art to which this application relates will appreciate that other and further additions, deletions, substitutions and modifications may be made to the described embodiments.

What is claimed is:

1. A wellbore tool, comprising:

a casing having an inner diameter and having three or more pads integrally formed therewith and extending radially outward therefrom, the casing and the three or more pads formed from a same material, at least one of the pads having a pocket therein;

one or more batteries and one or more sensors located within the pocket; and one or more additional components coupled to the one or more sensors using an electrical cable, the one or more additional components located within the inner diameter of the casing.

2. The wellbore tool of claim 1, wherein the three or more pads are substantially equally spaced.

3. The wellbore tool of claim 1, wherein an inner diameter (ID) of the casing may be accessed with conventional rotary drilling tools after reaching a geologic stop point.

4. The wellbore tool of claim 1, wherein the pocket is accessible from an exterior surface of the wellbore tool via a removable protective surface.

5. The wellbore tool of claim 1, further including a plurality of cutting elements located proximate a lower surface of the casing, the plurality of cutting elements forming at least a portion of a drill shoe.

6. The wellbore tool of claim 5, wherein the three or more pads, one or more batteries, and one or more additional components form at least a portion of a petro-physical property identification device, and further wherein the petro-physical property identification device and the drill shoe including the plurality of cutting elements form a single unitized piece.

7. The wellbore tool of claim 1, wherein the one or more additional components are one or more electronic components.

8. The wellbore tool of claim 1, wherein the one or more additional components are one or more mud pulse telemetry components.

9. The wellbore tool of claim 1, wherein a multi-piece conduit is located within the inner diameter of the casing.

10. The wellbore tool of claim 1, wherein at least two of the three or more pads are axially aligned.

11. The wellbore tool of claim 1, wherein at least three of the three or more pads are axially aligned.

12. The wellbore tool of claim 1, wherein the three or more pads are axially aligned.

13. A wellbore tool, comprising:

a casing having an inner diameter and having three or more pads integrally formed therewith and extending radially outward therefrom, the casing and the three or more pads formed from a same material, at least one of the pads having a pocket therein;

one or more batteries and one or more sensors located within the pocket; and one or more additional components coupled to the one or more sensors located within the inner diameter of the casing, wherein the three or more pads, one or more batteries, and one or more additional components form at least a portion of a petro-physical property identification device.

14. The wellbore tool of claim 13, further including a plurality of cutting elements located proximate a lower surface of the casing, the plurality of cutting elements forming at least a portion of a drill shoe.

15. The wellbore tool of claim 14, wherein the petro-physical property identification device and the drill shoe including the plurality of cutting elements form a single unitized piece.

* * * * *